US010040584B1

(12) United States Patent
Keaton

(10) Patent No.: US 10,040,584 B1
(45) Date of Patent: Aug. 7, 2018

(54) MULTI-PURPOSE TOOL AND METHOD FOR SECURING A LOCKING FASTENER

(71) Applicant: Gerald B. Keaton, Jacksonville, FL (US)

(72) Inventor: Gerald B. Keaton, Jacksonville, FL (US)

( * ) Notice: Subject to any disclaimer, the term of this patent is extended or adjusted under 35 U.S.C. 154(b) by 311 days.

(21) Appl. No.: 14/818,399

(22) Filed: Aug. 5, 2015

Related U.S. Application Data

(60) Provisional application No. 62/033,787, filed on Aug. 6, 2014.

(51) Int. Cl.

| | |
|---|---|
| ***B25B 7/22*** | (2006.01) |
| ***B65B 13/02*** | (2006.01) |
| ***B26B 17/00*** | (2006.01) |
| ***B25B 31/00*** | (2006.01) |
| ***F21V 33/00*** | (2006.01) |

(52) U.S. Cl.
CPC ..... *B65B 13/025* (2013.01); *B25B 7/22* (2013.01); *B25B 31/00* (2013.01); *B26B 17/00* (2013.01); *F21V 33/0084* (2013.01)

(58) Field of Classification Search
CPC .. A45D 29/02; B25B 7/06; B25B 7/22; B25B 31/00; H02G 1/12; B65B 13/025; F21V 33/0084; B26B 17/00
USPC ..... 7/168, 170, 125, 81, 118, 127–132; 81/13
See application file for complete search history.

(56) References Cited

U.S. PATENT DOCUMENTS

| | | | | |
|---|---|---|---|---|
| 680,030 | A | 8/1901 | Emans | |
| 854,891 | A * | 5/1907 | Huffman | B25F 1/04 30/144 |
| 2,212,013 | A | 8/1940 | Devareaux | |
| 2,320,967 | A | 6/1943 | Dukenberger | |
| 2,947,564 | A * | 8/1960 | Winther | B25J 1/04 294/100 |
| 3,171,193 | A * | 3/1965 | Bowden | B25B 27/0028 254/134.3 FT |
| 3,206,844 | A * | 9/1965 | Bowden | B25B 27/0028 254/134.3 FT |
| 3,824,165 | A | 7/1974 | Miranda | |
| 3,857,592 | A | 12/1974 | Koike | |
| 4,528,751 | A * | 7/1985 | Olson | A22C 21/063 294/55.5 |
| 5,089,007 | A * | 2/1992 | Kirsch | A61B 17/32 294/99.2 |
| 5,177,847 | A * | 1/1993 | Ottone | B25B 31/00 254/131 |
| 5,199,419 | A * | 4/1993 | Remiszewski | A61B 1/32 600/204 |
| 5,313,376 | A * | 5/1994 | McIntosh | B26B 11/008 362/119 |

(Continued)

*Primary Examiner* — Ryan J Walters
*Assistant Examiner* — Lawrence Averick
(74) *Attorney, Agent, or Firm* — Allen Dyer Doppelt & Gilchrist, PA

(57) ABSTRACT

Disclosed is a multi-purpose tool having two elongated handles and a head portion pivotably connected about a common pivot joint. A flexible tubular element is connected to one of the two elongated handles. A gripping element is housed within a distal end of the tubular element. The gripping element can be extended or retracted from the distal end of the tubular element. A lighting element is attached to the distal end of the tubular element to illuminate working area.

11 Claims, 10 Drawing Sheets

(56) References Cited

U.S. PATENT DOCUMENTS 5,338,317 A * 8/1994 Hasson ..... A61B 17/2909 600/564
5,432,968 A * 7/1995 Beck ..... B25F 1/003 7/127
5,573,329 A * 11/1996 van Gennep ..... B25B 7/22 248/229.13
D376,967 S * 12/1996 Fuller ..... D8/14
5,642,913 A * 7/1997 Brown ..... A45D 29/007 132/73
5,690,416 A * 11/1997 Van Gennep ..... B25B 5/006 362/191
5,765,251 A * 6/1998 Jones ..... B08B 9/0436 15/104.32
5,937,498 A * 8/1999 Ploeger ..... B25B 27/00 29/278
6,088,860 A * 7/2000 Poehlmann ..... B25F 1/003 30/161
6,119,561 A * 9/2000 Anderson ..... B25F 1/003 7/129
6,182,541 B1 * 2/2001 Anderson ..... B25F 1/003 7/118
6,220,127 B1 * 4/2001 Berg ..... B25F 1/003 7/128
6,226,822 B1 * 5/2001 Chen ..... B25F 1/003 30/260
6,257,106 B1 * 7/2001 Anderson ..... B25F 1/003 7/129
6,283,434 B1 * 9/2001 Holder ..... A47G 1/205 248/489
6,312,138 B1 * 11/2001 Coleman, Jr. ..... B25B 9/00 294/65.5
6,315,340 B1 * 11/2001 Chen ..... B25B 9/00 294/100
6,341,423 B1 * 1/2002 Taggart ..... B25F 1/003 30/143
6,408,522 B2 * 6/2002 Rivera ..... B25F 1/003 30/155
6,430,797 B1 8/2002 Dittmar
6,592,602 B1 * 7/2003 Peartree ..... A61B 17/00234 600/204
6,769,331 B2 * 8/2004 Berg ..... B25F 1/003 7/128
6,983,506 B1 * 1/2006 Brown ..... B25F 1/003 7/118
7,415,745 B2 * 8/2008 Rivera ..... B25F 1/003 30/152
7,527,311 B2 * 5/2009 Shih ..... B25J 1/02 294/100
7,780,650 B2 * 8/2010 Frassica ..... A61M 25/0017 600/101
7,913,591 B2 * 3/2011 Nenadic ..... B25F 1/04 7/118
8,092,489 B2 * 1/2012 Ewers ..... A61B 17/29 606/208
8,828,027 B2 * 9/2014 Vaughan ..... A61B 17/10 606/139
2003/0187472 A1 * 10/2003 Peartree ..... A61B 17/00234 606/190
2005/0075653 A1 * 4/2005 Saadat ..... A61B 1/00135 606/139
2005/0096676 A1 * 5/2005 Gifford, III ..... A61B 17/064 606/153
2005/0200143 A1 * 9/2005 Maestas ..... F21L 4/04 294/65.5
2005/0251165 A1 * 11/2005 Vaughan ..... A61B 17/0401 606/153
2007/0005041 A1 * 1/2007 Frassica ..... A61M 25/0017 604/544
2007/0186351 A1 * 8/2007 Linn ..... B25F 1/003 7/129
2008/0262539 A1 * 10/2008 Ewers ..... A61B 17/29 606/206
2009/0076503 A1 * 3/2009 Bertolero ..... A61B 1/12 606/41
2010/0036380 A1 * 2/2010 Taylor ..... A61B 17/29 606/52
2010/0076264 A1 * 3/2010 Tallarida ..... A61B 17/12099 600/137
2010/0122419 A1 * 5/2010 Zupancic-Albin .... A61J 7/0007 7/125
2010/0139007 A1 * 6/2010 Anderson ..... B25B 23/18 7/118
2010/0249814 A1 * 9/2010 Vaughan ..... A61B 17/0401 606/153
2011/0307069 A1 * 12/2011 Frassica ..... A61M 25/0017 623/23.7
2011/0319713 A1 * 12/2011 Frassica ..... A61B 1/00154 600/114
2012/0004504 A1 * 1/2012 Frassica ..... A61M 25/0017 600/115
2012/0010598 A1 * 1/2012 Frassica ..... A61M 25/0017 604/528
2012/0130164 A1 * 5/2012 Palese ..... A61B 17/52 600/104
2012/0245604 A1 * 9/2012 Tegzes ..... A61B 17/0401 606/151
2013/0104363 A1 5/2013 Allen
2013/0165754 A1 * 6/2013 Frassica ..... A61B 1/00082 600/114
2013/0165856 A1 * 6/2013 Frassica ..... A61B 1/00082 604/95.01
2013/0253537 A1 * 9/2013 Saadat ..... A61B 17/0401 606/139
2013/0304095 A1 * 11/2013 Barner ..... A61B 17/1285 606/142
2014/0054912 A1 * 2/2014 Bustos ..... B25J 1/02 294/190
2014/0064820 A1 * 3/2014 Mach ..... B43K 7/03 401/52
2015/0008148 A1 * 1/2015 Shelton ..... A45C 11/00 206/234
2015/0062876 A1 * 3/2015 Brauner ..... B25B 7/06 362/119
2015/0183105 A1 * 7/2015 Keng ..... B25F 1/003 7/127
2015/0196311 A1 * 7/2015 Chu ..... A61B 17/221 606/127
2017/0202609 A1 * 7/2017 Shelton, IV ..... A61B 18/1445

* cited by examiner

MULTI-PURPOSE TOOL AND METHOD FOR SECURING A LOCKING FASTENER

CROSS-REFERENCE TO RELATED APPLICATION

This application claims the benefit of U.S. Provisional Patent Application Ser. No. 62/033,787, filed on Aug. 6, 2014, the contents of which application are herein incorporated by reference in their entirety.

FIELD OF THE INVENTION

The present invention generally relates to hand held tools, and more particularly to a multi-purpose tool and method for securing locking fasteners that are used to secure intermodal containers loaded onto the chassis of a truck.

BACKGROUND OF THE INVENTION

A typical intermodal container is a standardized steel box. These containers are used to move materials and products from ship, to rail, and to truck without unloading and reloading the contents of the container. A typical container has doors at one end, and at each of the corners there are castings for receiving locking fasteners. The locking fasteners are used to secure the container during handling and transit.

When the containers are transported by truck, the drivers are responsible to confirm that the bottom four corners of the container are properly secured to the chassis of the truck by locking fasteners. A locking fastener can include a locking rod that slides into an opening of the casting at the corner of the container and a locking lever that is forced down over a handle of the locking rod. The locking fastener can also be a twist lock that slides into a bottom opening of the casting and twists 90 degrees. In addition, drivers are required to secure each locking fastener in place with a zip tie to ensure that they will not jiggle loose. Often, a driver must secure a zip tie at night or in inclement weather. The tight confines of the locations of the locking fasteners make it difficult to confirm that a zip tie has been properly secured through a locking fastener. It is critical that a zip tie be properly secured to prevent the locking fastener from coming loose. If one or more corners of a container were to become loose, the container could slide laterally across and off the supporting chassis of the truck, causing significant damage. A shortcoming of the related prior art is the inefficiency and difficulty of installing the zip ties needed to ensure that that locking fasteners do not come loose. Accordingly, a multi-purpose tool for securing locking fasteners quickly and precisely in all conditions is needed. Despite significant recent advancements in this area, further improvements are possible.

SUMMARY OF THE INVENTION

In view of the foregoing, it is an object of the present invention to provide a multi-purpose tool and method for securing locking fasteners. In one embodiment, the multi-purpose tool includes two elongated handles connected about a common pivot joint and a head portion connected about the common pivot joint. The head portion includes a cutting tool. A flexible tubular element is connected to one of the two elongated handles. A gripping element is housed within a distal end of the tubular element. The gripping element can be extended or contracted from the distal end of the tubular element by a slide disposed on the elongated handle to which the tubular element is attached. A first lighting element is housed within the distal end of the flexible tubular element. A rotatable second lighting element is mounted on one of the two elongated handles.

Another embodiment of the present invention is directed to methods of securing locking fasteners using the disclosed multi-purpose tool. An example method includes inserting an end of a tie fastener (e.g., zip tie) through a first aperture disposed on a first side of a locking fastener (e.g., a locking lever), where the locking fastener (e.g., locking lever) is used to secure a locking rod of a truck in a locked position. The flexible tubular element of the multi-purpose tool is inserted through a second aperture disposed on a second side of locking fastener (e.g., locking lever). A user can manipulate (e.g., pushed forward) the slide of the multi-purpose tool to extend and open the gripping element outwardly from the distal end of the tubular element. The slide can also be manipulated (e.g. pushed backward) to close and grip on the end of the zip tie. The end of the tie fastener (e.g., zip tie) is pulled back through the second aperture to a desired position to form a closed loop around the locking fastener (e.g., locking lever). A cutting tool on the head portion of the multi-purpose tool is used to cut the tie fastener (e.g., zip tie) when needed.

BRIEF DESCRIPTION OF THE DRAWINGS

Features and benefits of the present invention will become apparent as the description proceeds when taken in conjunction with the accompanying drawings in which.

DETAILED DESCRIPTION OF PREFERRED EMBODIMENTS

Figure 1:
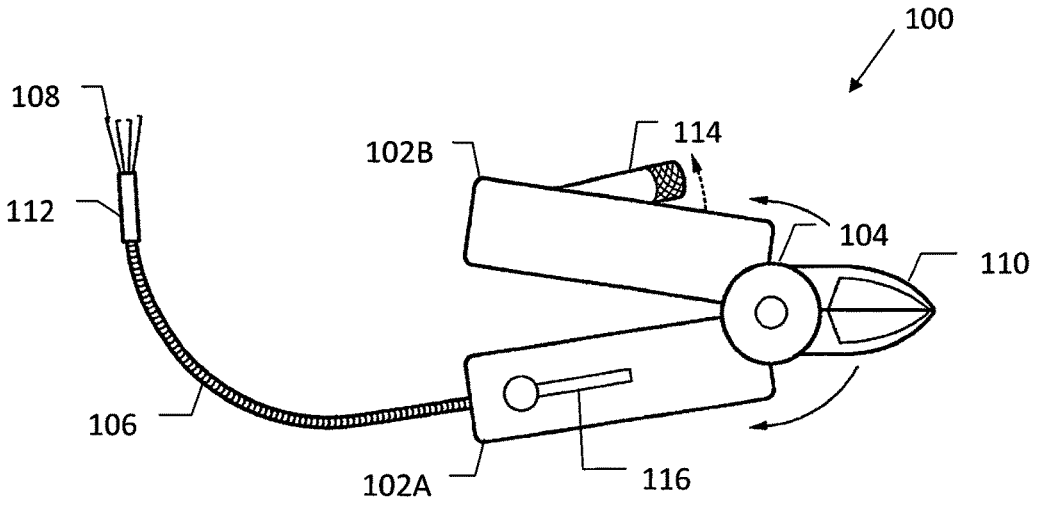
FIG. 1 is a top view of a multi-purpose tool in an unfolded state according to an embodiment of the present invention.

The present invention will now be described more fully hereinafter with reference to the accompanying drawings, in which various embodiments of the invention are shown. This invention can, however, be embodied in many different forms and should not be construed as limited to the embodiments set forth herein. Rather, these embodiments are provided so that this disclosure will be thorough and complete, and fully convey the scope of the invention to those skilled in the art. Like numbers refer to like elements throughout.

Referring now to FIGS. 1-8, the multi-purpose tool 100 includes two elongated handles 102A and 102B, which are connected about a common pivot joint 104. A flexible tubular element 106 is connected to the distal end of handle 102A. A gripping element 108 is housed within the distal end of the tubular element 106. A head portion 110 is connected about the common pivot joint 104.

Figure 2:
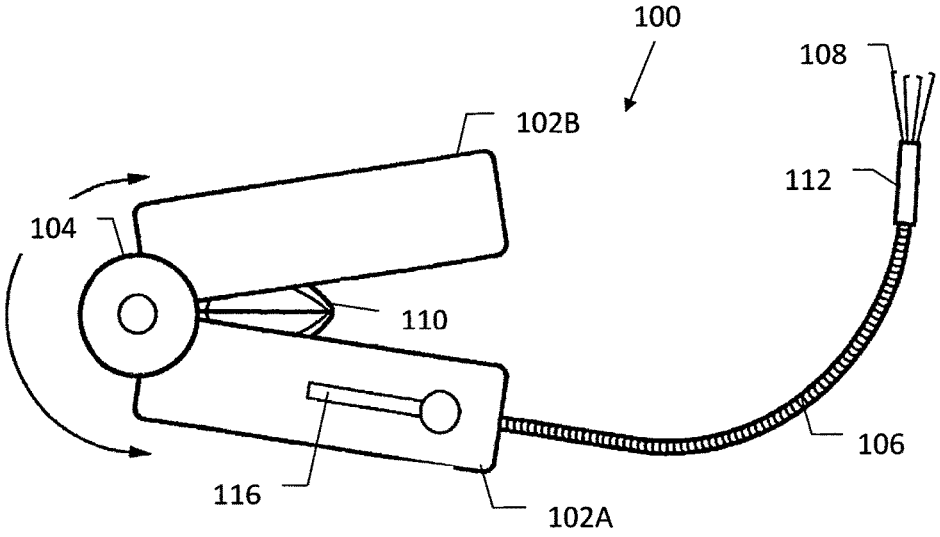
FIG. 2 is a top view of the multi-purpose tool of FIG. 1 in a partially folded state.
Figure 4:
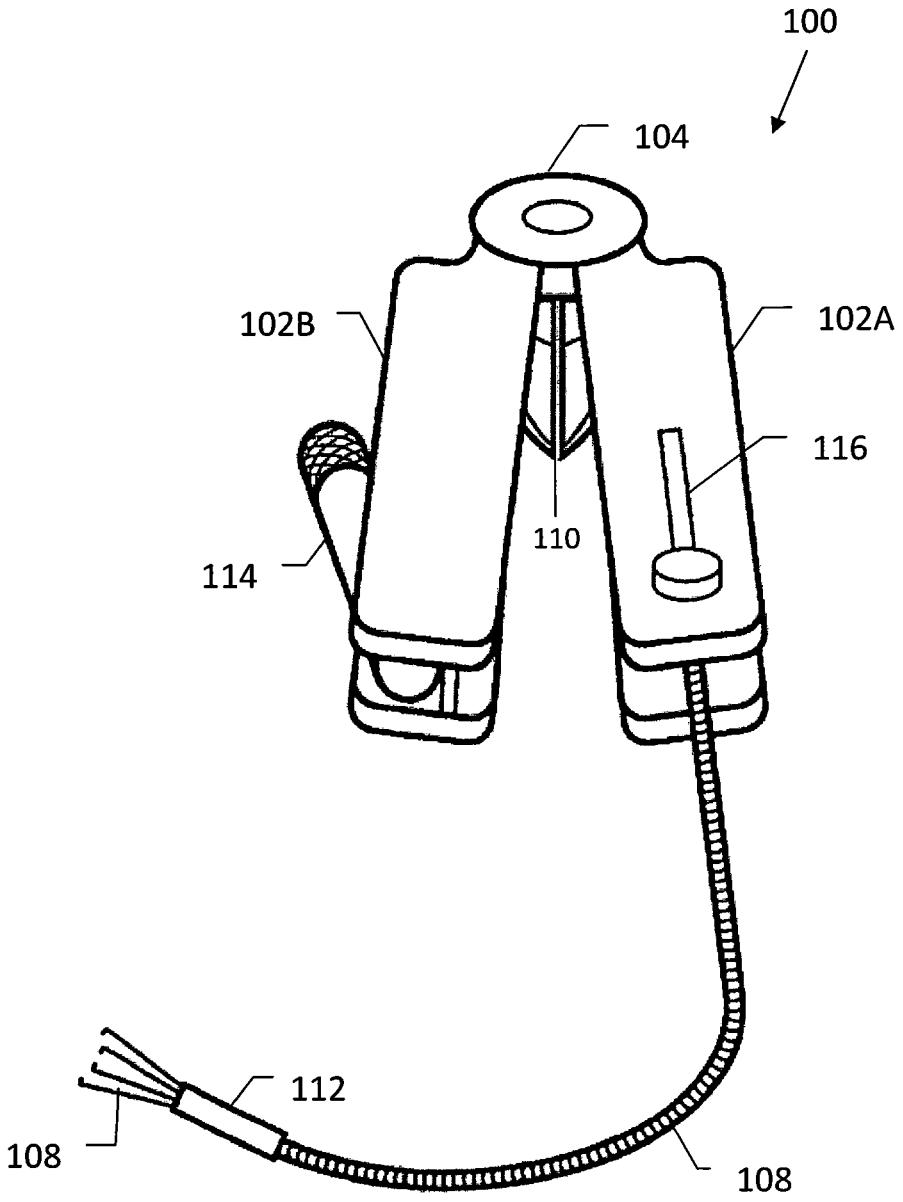
FIG. 4 is a perspective rear view of a multi-purpose tool of FIG. 1 in the partially folded state.
Figure 6:
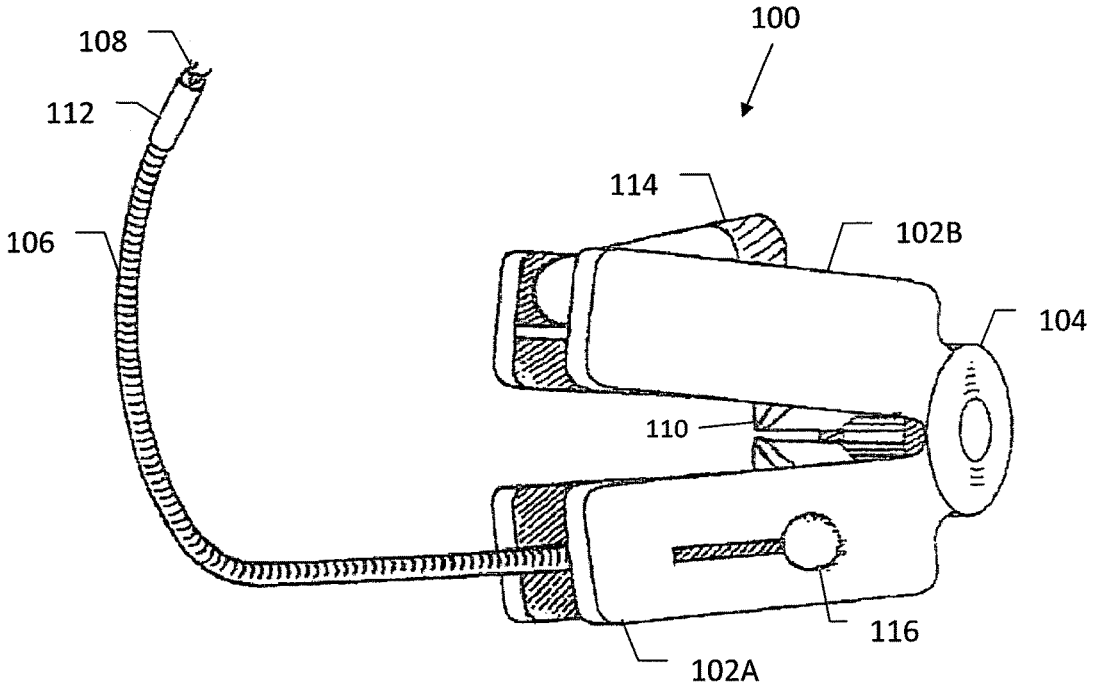
FIG. 6 is a perspective top view of the multi-purpose tool of FIG. 1 in the partially folded state.
Figure 7:
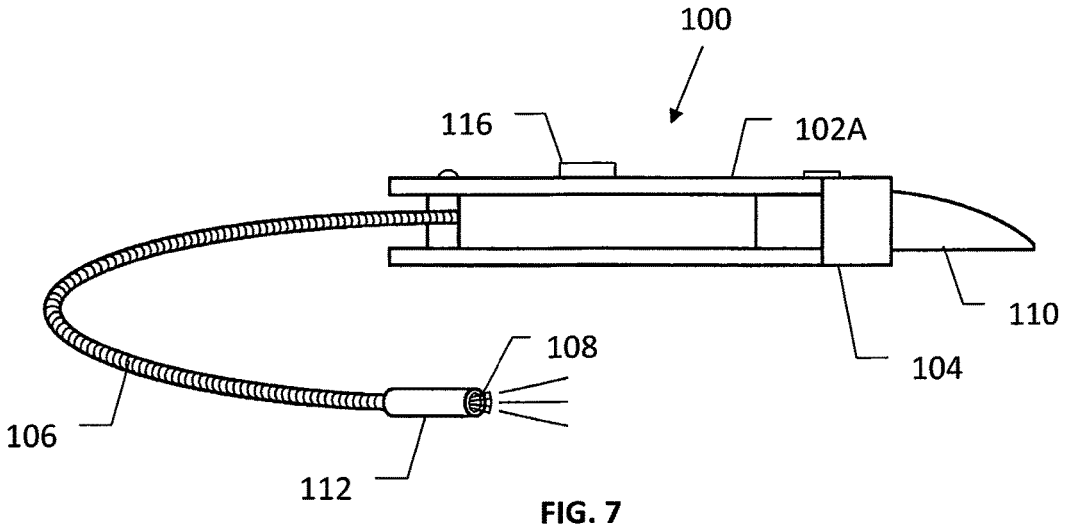
FIG. 7 is a side view of the multi-purpose tool of FIG. 1 in an unfolded state.
Figure 8:
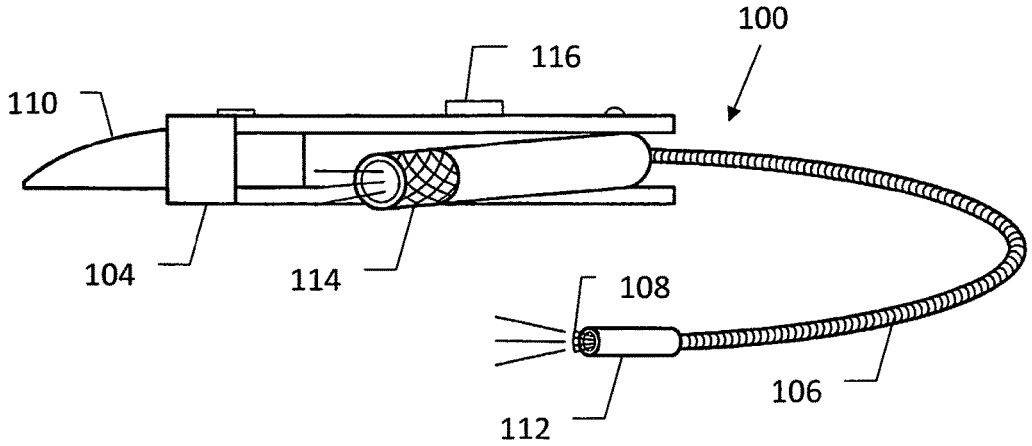
FIG. 8 is another side view of the multi-purpose tool of FIG. 1 in an unfolded state.

The multi-purpose tool 100 is foldable. Each of the two elongated handles 102A and 102B can rotate around the pivot joint 104 by 180 degrees. In a folded state, as shown in FIGS. 2, 4 and 6, the two elongated handles 102A and 102B are positioned on the same side of the pivot joint 104 as the head portion 110. The head portion 110 is recessed between the two elongated handles 102A and 102B. For clarity of illustration, the handles 120A and 102B are not completely folded in FIGS. 2, 4 and 6. In the completely folded position, the handles 102A and 102B would be in contact, such that the head portion 110 is completely enclosed therebetween.

Figure 3:
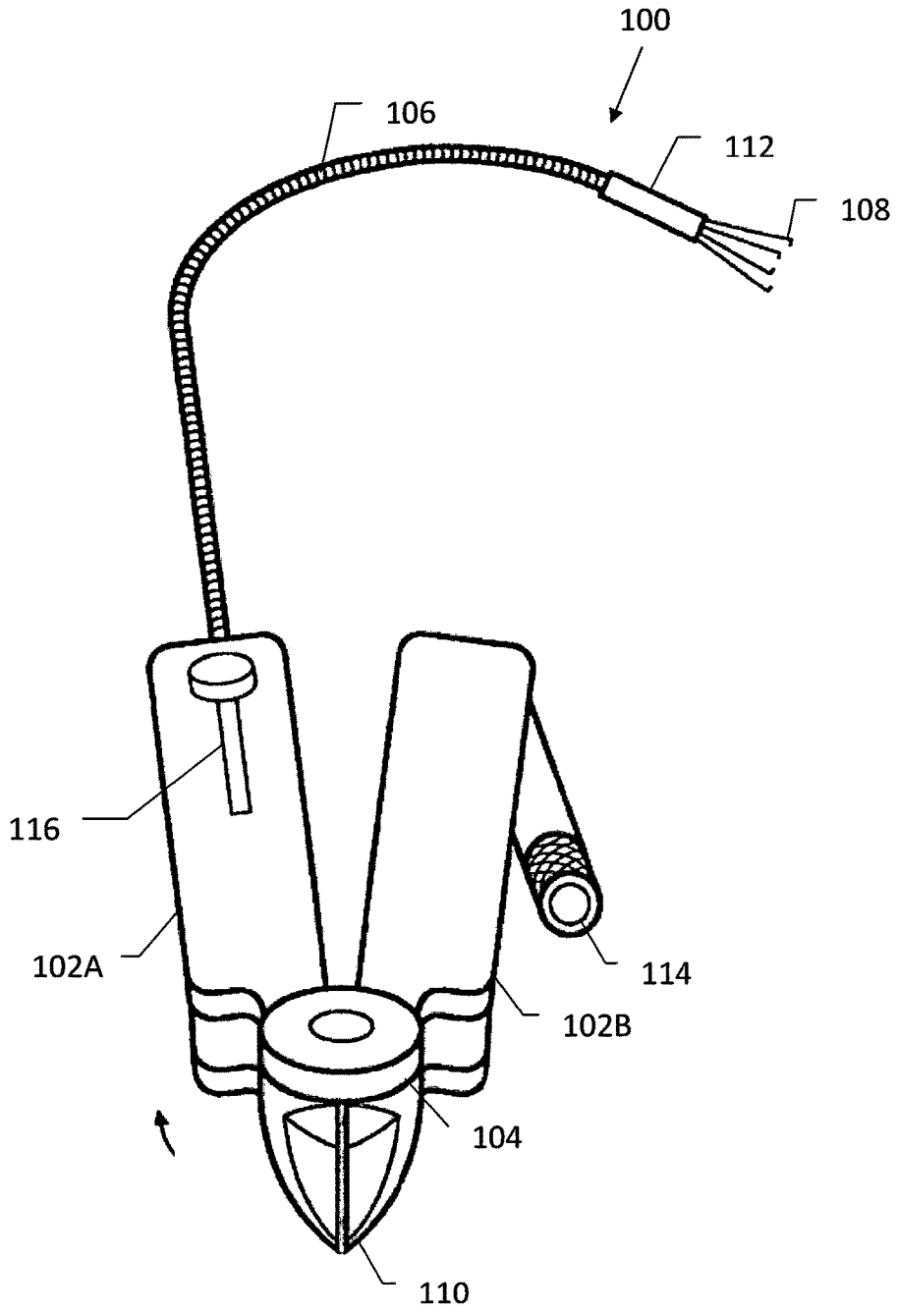
FIG. 3 is a perspective front view of the multi-purpose tool of FIG. 1 in the unfolded state.
Figure 5:
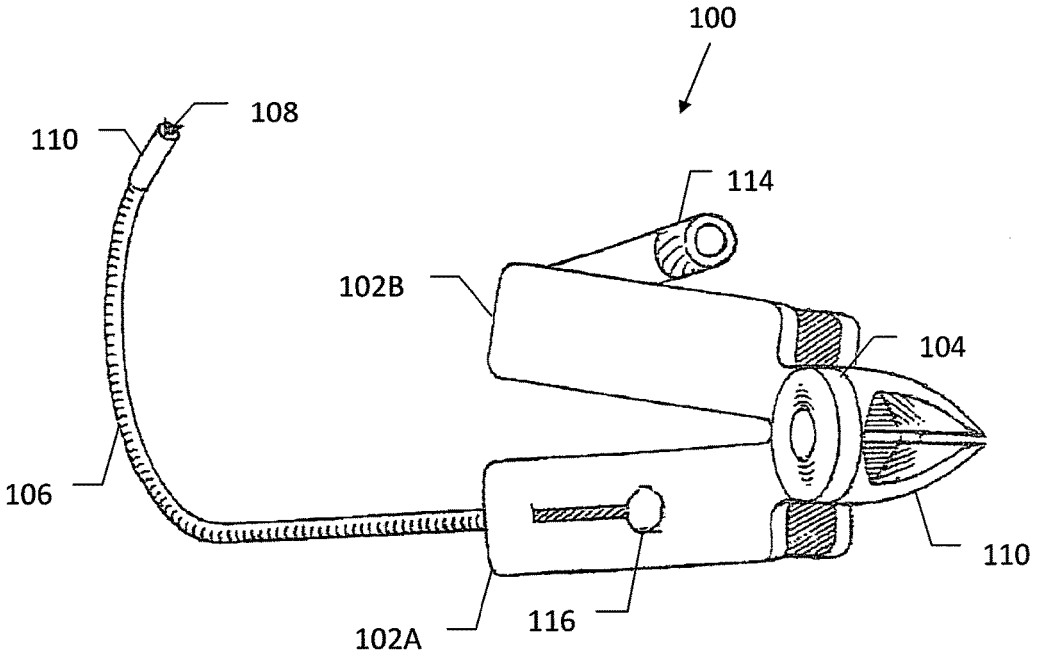
FIG. 5 is a perspective top view of the multi-purpose tool of FIG. 1 in an unfolded state.

The gripping element 108 can be used in the folded or unfolded states. In an unfolded state, as shown in FIGS. 1, 3 and 5, the two elongated handles 102A and 102B are positioned on the opposite side of the pivot joint 104 from the head portion 110. The head portion 110 is available for use in the unfolded state, with a cutting motion of the head portion 110 accomplished by pivoting the handles 102A, 102B.

The two elongated handles 102A and 102B are sized and shaped to be easily grasped by a user's hand. For example, the handles 102A and 102B can be constructed with complex curves and surface textures made from molded or formed metal, plastics, other appropriate materials, or combinations thereof. Referring to FIGS. 3-6, in the depicted embodiment, the two elongated handles 102A and 102B each comprises a pair of planar elements with a corresponding aperture and in between. The pair of planar elements in each elongated handle are generally parallel to each other. In this scenario, the head portion 110 can be recessed inside the apertures of the elongated handles 102A and 102B when the multi-purpose tool 100 is in the folded state.

A first lighting element 112 in preferably installed in the distal end of the tubular element 106. The first lighting element 112 can be automatically turned on when the gripping element 108 is extended outwardly from the distal end of the tubular element 106 and automatically turned off when the gripping element 108 is retracted into the distal end. A rotatable second lighting element 114 is mounted on one of the two elongated handles 102A and 102B. Advantageously, the second lighting element 114 is mounted on a different handle from the first lighting element 112.

A mechanical (e.g., actuation) mechanism controls the gripping element 108 between an open state and a closed state. For example, the gripping element 108 is connected to the slide 116 via a cable arm affixed inside the flexible tubular element 106. As the slide 116 is moved forward, the gripping element 110 protrudes and opens from the distal end of the flexible tubular element 106 in order to grab an object. In one embodiment, when the slide 116 is moved backward half way, the gripping element 110 closes and secures the object within the gripping element 110. When the slide 116 moves backward all the way, the object is released and the gripping element 110 is retracted within the distal end of the elongated handle 102A. The cable arm can be made of braided metal, plastic resilient, or a combination thereof.

The head portion 110 includes one or more cutting tools, such as a scissor or the like, to sever an object by a scissor-like action between a pair of blades or by any other cutting action. For example, the cutting tool can sever a fastener such as a zip tie. The cutting tool can have a sharp or serrated blade.

The multi-purpose tool 100 can have many different appearances and configurations. The multi-purpose tool 100 can be composed of a variety of materials, including metals, alloys, plastics, or any other material that is sufficiently rigid so as to withstand normal wear and tear during use of the multi-purpose tool 100 and at the same time lightweight for easy handling and transportation.

Figure 9:
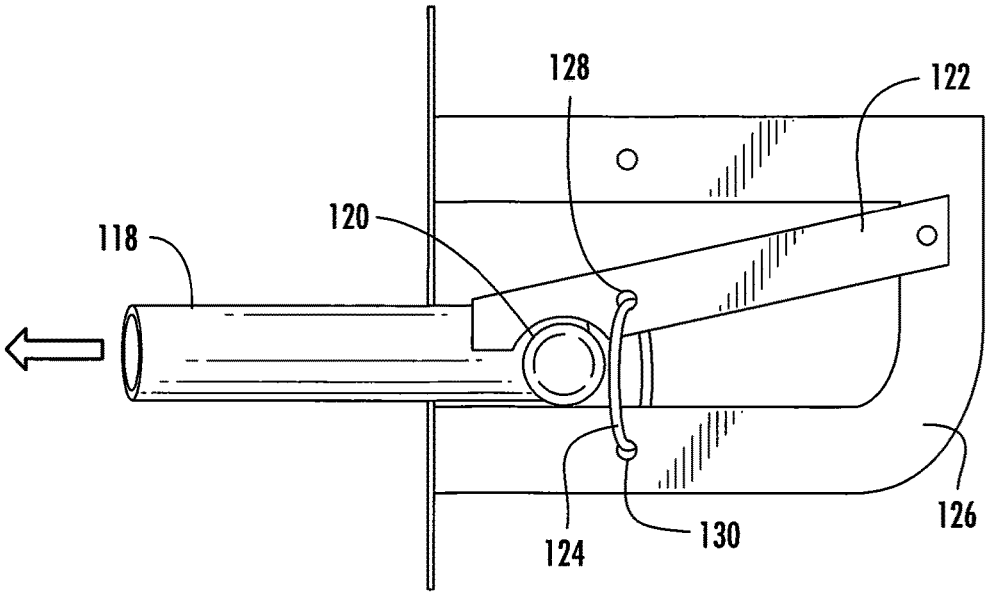
FIG. 9 is a side view of working environment of a locking fastener with a locking rod and a locking lever engaged. The locking fastener can be secured using the multi-purpose tool of FIG. 1.

In one embodiment, the multi-purpose tool 100 can be used to secure locking fasteners or other objects. Referring to FIG. 9, a handle 118 of a locking rod 120 is engaged with the locking lever 122. The handle 118 of the locking rod 120 is oriented by an approximately 90 degree rotation from the locking rod 120 and may have a cylindrical shape. The locking lever 122 includes a notch that is configured to receive and prevent the handle 118 from moving backwards out of the intermodal container (to the right in FIG. 9) once the locking lever 122 is engaged. After the locking lever 122 is engaged with the handle 118, a zip tie 124 is used to prevent the locking lever 122 from moving upward and secure the locking lever 122 down to the truck chassis 126.

To install the zip tie 124, an end of the zip tie 124 is passed through a first aperture 128 in the locking lever 122. The multi-purpose tool 100 is then used to pull the end of the zip tie 122 back through a second aperture 130 disposed in the truck chassis 126. Specifically, the flexible tubular element 106 of the multi-purpose tool 100 is inserted through the second aperture 130. A user then extends and opens the gripping element 108 outwardly from the distal end of the flexible tubular element 106. The first lighting element 112 is turned on automatically to illuminate the working area. The second lighting element 114 can also be turned on if needed. Once the gripping element 108 has gripped the end of zip tie 124, the flexible tubular element 106 is pulled back through the second aperture 130 along with the end of the zip tie 124. The zip tie 124 can then be fixedly secured into a loop around the locking lever 122 and the chassis 126. When the container arrives at the desired location, the zip tie 124 can be opened with the cutting tool in the head portion 110 of the multi-purpose tool 100.

Figure 10:
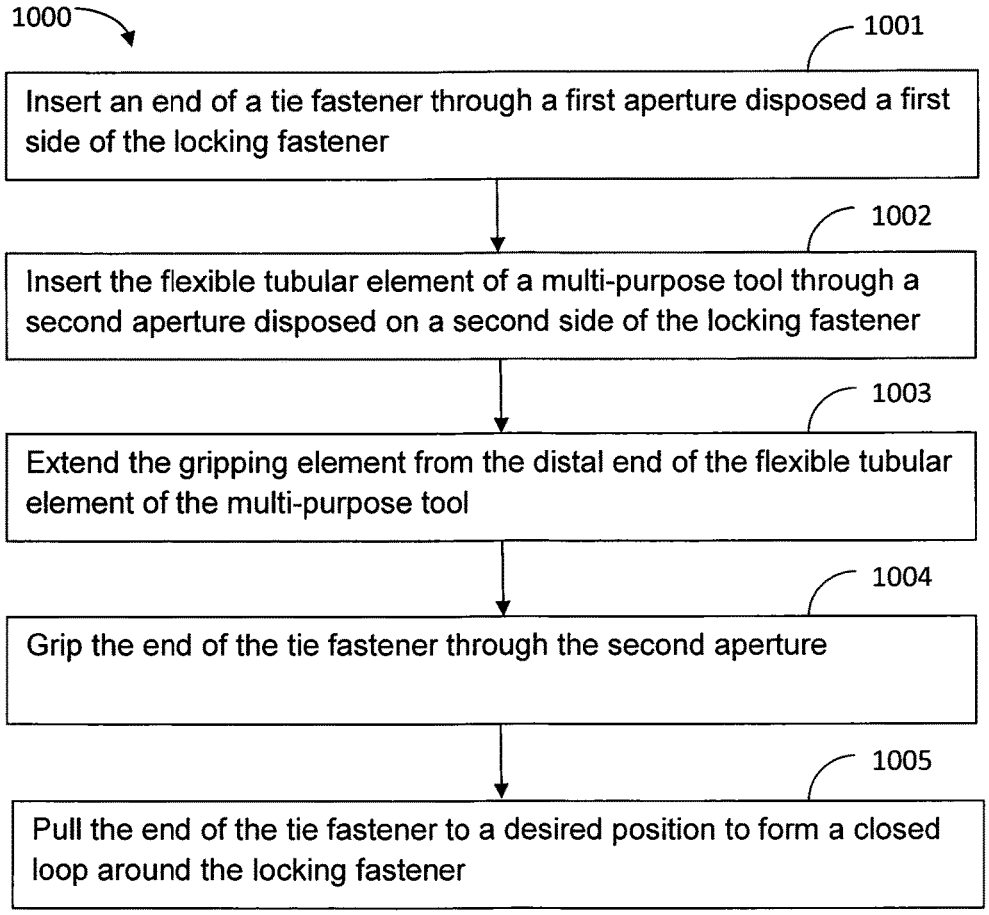
FIG. 10 is a flow diagram of a particular embodiment of a method for securing a locking fastener.

Referring now to FIG. 10, a flow diagram of an example method 1000 of securing a locking fastener using the multi-purpose tool 100. At 1001, an end of a tie fastener (e.g., zip tie 124) is inserted through a first aperture 128 disposed on a first side of a locking fastener (e.g., locking lever 122), where the locking fastener (e.g., locking lever 122) is used to secure a locking rod 120 of a truck in a locked position. At 1002, the flexible tubular element 106 of the multi-purpose tool 100 is inserted through a second aperture 130 disposed on a second side of locking fastener (e.g., locking lever 122). At 1003, a slide 116 on the multi-purpose tool 100 is manipulated (e.g., pushed forward) to extend and open the gripping element 108 outwardly from the distal end of the tubular element 106. At 1004, the slide 116 is manipulated (e.g. pushed backward) to close and grip on the end of the zip tie 124. At 1005, the end of the tie fastener (e.g., zip tie 124) is pulled back through the second aperture 130 to a desired position to form a closed loop around the locking fastener (e.g., locking lever 122). A cutting tool on the head portion 110 of the multi-purpose tool is used to cut the tie fastener (e.g., zip tie 124) when needed.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within.

What is claimed is:

1. A multi-purpose tool comprising:

two elongated handles pivotably connected about a common pivot joint;

a head portion connected about the common pivot joint;

a flexible tubular element connected to one of the two elongated handles; and a gripping element housed within a distal end of the tubular element;

wherein the gripping element is configured to be extended and retracted from the distal end of the tubular element;

wherein a slide mounted on the elongated handle to which the tubular element attaches is configured to extend and retract the gripping element; and wherein the gripping element is connected to the slide via a cable arm affixed inside the flexible tubular element.

2. The multi-purpose tool of claim 1, wherein each of the two elongated handles comprises two planar elements with an aperture in between.

3. The multi-purpose tool of claim 2, wherein a second lighting element is rotatably mounted within the aperture between the two planar elements of an elongated handle.

4. The mufti-purpose tool of claim 1, wherein a first lighting element is housed within the distal end of the flexible tubular element.

5. The multi-purpose tool of claim 4, wherein the first lighting element is configured to be turned on automatically when the gripping element is extended outwardly from the distal end of the tubular element.

6. The multi-purpose tool of claim 1, wherein a second lighting element is rotatably mounted on one of the two elongated handles.

7. The multi-purpose tool of claim 1, wherein each of the two elongated handles rotates around the common pivot joint around 180 degrees.

8. The multi-purpose tool of claim 1, wherein the two elongated handles and the head portion are positioned on a same side of the common pivot joint in a folded state.

9. The multi-purpose tool of claim 1, wherein the two elongated handles and the head portion are positioned on an opposite side of the common pivot joint in an unfolded state.

10. The mufti-purpose tool of claim 1, wherein the head portion comprises a cutting tool.

11. The multi-purpose tool of claim 1, wherein the slide is further configured to open or close the gripping element.

* * * * *